US008975550B2

(12) United States Patent
Sugai et al.

(10) Patent No.: US 8,975,550 B2
(45) Date of Patent: Mar. 10, 2015

(54) SWITCH UNIT AND SWITCHGEAR

(75) Inventors: Daisuke Sugai, Hitachinaka (JP); Takashi Sato, Mito (JP); Tomoaki Utsumi, Hitachi (JP); Takashi Shirone, Hitachi (JP); Kazuhiro Satou, Hitachinaka (JP); Takafumi Hosono, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 308 days.

(21) Appl. No.: 13/344,381

(22) Filed: Jan. 5, 2012

(65) Prior Publication Data

US 2012/0175234 A1 Jul. 12, 2012

(30) Foreign Application Priority Data

Jan. 6, 2011 (JP) ..... 2011-000895

(51) Int. Cl.

*H01H 9/40* (2006.01)
*H01H 33/666* (2006.01)
*H01H 31/00* (2006.01)

(52) U.S. Cl.

CPC ..... *H01H 33/6661* (2013.01); *H01H 31/003* (2013.01)
USPC ..... 218/4

(58) Field of Classification Search

USPC ..... 218/2–14, 47–50, 69, 70, 152–154; 200/5 R

See application file for complete search history.

(56) References Cited

U.S. PATENT DOCUMENTS

| | | | | | |
|---|---|---|---|---|---|
| 2,913,556 | A | * | 11/1959 | Leeds | 218/4 |
| 3,033,962 | A | * | 5/1962 | Friedrich et al. | 218/4 |
| 3,123,698 | A | * | 3/1964 | Waterton | 218/4 |
| 3,792,213 | A | * | 2/1974 | Kane et al. | 218/4 |
| 3,813,506 | A | | 5/1974 | Mitchell | |
| 6,259,051 | B1 | | 7/2001 | Tanimizu et al. | |
| 6,335,502 | B1 | | 1/2002 | Kikukawa et al. | |
| 6,683,267 | B1 | * | 1/2004 | Piazza et al. | 218/2 |
| 7,091,439 | B2 | | 8/2006 | Vaghini et al. | |
| 2002/0195425 | A1 | | 12/2002 | Perret et al. | |
| 2008/0245772 | A1 | | 10/2008 | Anger et al. | |

FOREIGN PATENT DOCUMENTS

| | | | |
|---|---|---|---|
| CN | 1393900 | A | 1/2003 |
| CN | 1598993 | A | 3/2005 |
| CN | 1645697 | A | 7/2005 |
| CN | 101258574 | A | 9/2008 |
| EP | 1 538 650 | A2 | 6/2005 |
| EP | 2 048 682 | A1 | 4/2009 |
| JP | 50-41068 | | 4/1975 |
| JP | 2003-47113 | A | 2/2003 |
| JP | 2003-123601 | A | 4/2003 |
| JP | 2007-28810 | A | 2/2007 |

(Continued)

OTHER PUBLICATIONS

Japanese Office Action dated Apr. 23, 2013 with partial English translation (five (5) pages).

(Continued)

*Primary Examiner* — Felix O Figueroa
(74) *Attorney, Agent, or Firm* — Crowell & Moring LLP

(57) ABSTRACT

A switch unit includes a plurality of switches, which are linearly disposed. The movable electrode in one switch and the fixed electrode in another switch are electrically connected to each other.

13 Claims, 4 Drawing Sheets

(56) References Cited

FOREIGN PATENT DOCUMENTS

| | | | |
|---|---|---|---|
| JP | 2009-508294 | A | 2/2009 |
| WO | WO 00/21108 | A1 | 4/2000 |
| WO | WO 2005/062325 | A1 | 7/2005 |
| WO | WO 2007/031040 | A1 | 3/2007 |

OTHER PUBLICATIONS

Extended European Search Report dated Apr. 23, 2012 (seven (7) pages).
Chinese Office Action with English translation dated Dec. 4, 2013 (Nineteen (19) pages).

* cited by examiner

SWITCH UNIT AND SWITCHGEAR

CLAIM OF PRIORITY

The present application claims priority from Japanese Patent application serial No. 2011-895, filed on Jan. 6, 2011, the content of which is hereby incorporated by reference into this application.

TECHNICAL FIELD

The present invention relates to a switch unit and switchgear.

BACKGROUND ART

A power receiving facility has an enclosed switchboard (called switchgear) that houses a circuit breaker for interrupting a load current or fault current, a disconnector and an earth switch that assure safety for a worker during maintenance of a load, a detector for detecting a system voltage and current, and all or part of other devices such as a protective relay.

Switchgear is often installed in a limited space and is thereby required to be compact. Since a switch unit including switches such as breakers occupies a large volume in the switchgear, it is desirable to make the switch unit compact when the size of the switchgear is determined.

A conventional switch is described in, for example, Patent Literature 1. In FIG. 2 of Patent Literature 1, two contact portions are linearly provided in the vertical direction; two moving contact rods are also provided in the vertical direction; and contact disks are provided between the upper and lower moving contact rods.

CITATION LIST

Patent Literature

Patent Literature 1: Patent Application Publication No. 2009-508294 (Corresponding Publications: US2008/0245772A1)

SUMMARY OF INVENTION

Technical Problem

In the structure described in FIG. 2 of Patent Literature 1, however, the contact disks provided on the fixed contact piece are electrically connected to each other, so buses and cables are decentralized and the high-voltage part becomes large, making it difficult to reduce the size of the switch unit. In view of this situation, an object of the present invention is to provide a switch unit or switchgear that can be made to be compact.

Solution to Problem

To solve the above problem, the switch unit according to the present invention has a plurality of linearly arranged switches, in which a movable electrode in a switch and a fixed electrode in another switch are electrically connected to each other.

The switchgear according to the present invention has the above switch unit, a bus connected to the switch unit, a cable connected to the switch unit, and a cabinet in which at least part of these components are accommodated.

Advantageous Effects of Invention

The present invention can provide a switch unit or switchgear that can be made to be compact.

DESCRIPTION OF EMBODIMENTS

Preferable embodiments in the present invention will be described below with reference to the drawings. The embodiments described below are just examples that embody the present invention, and do not limit the present invention to specific aspects of the following embodiments.

First Embodiment

A first embodiment will be described with reference to FIGS. 1 to 3.

Figure 1:
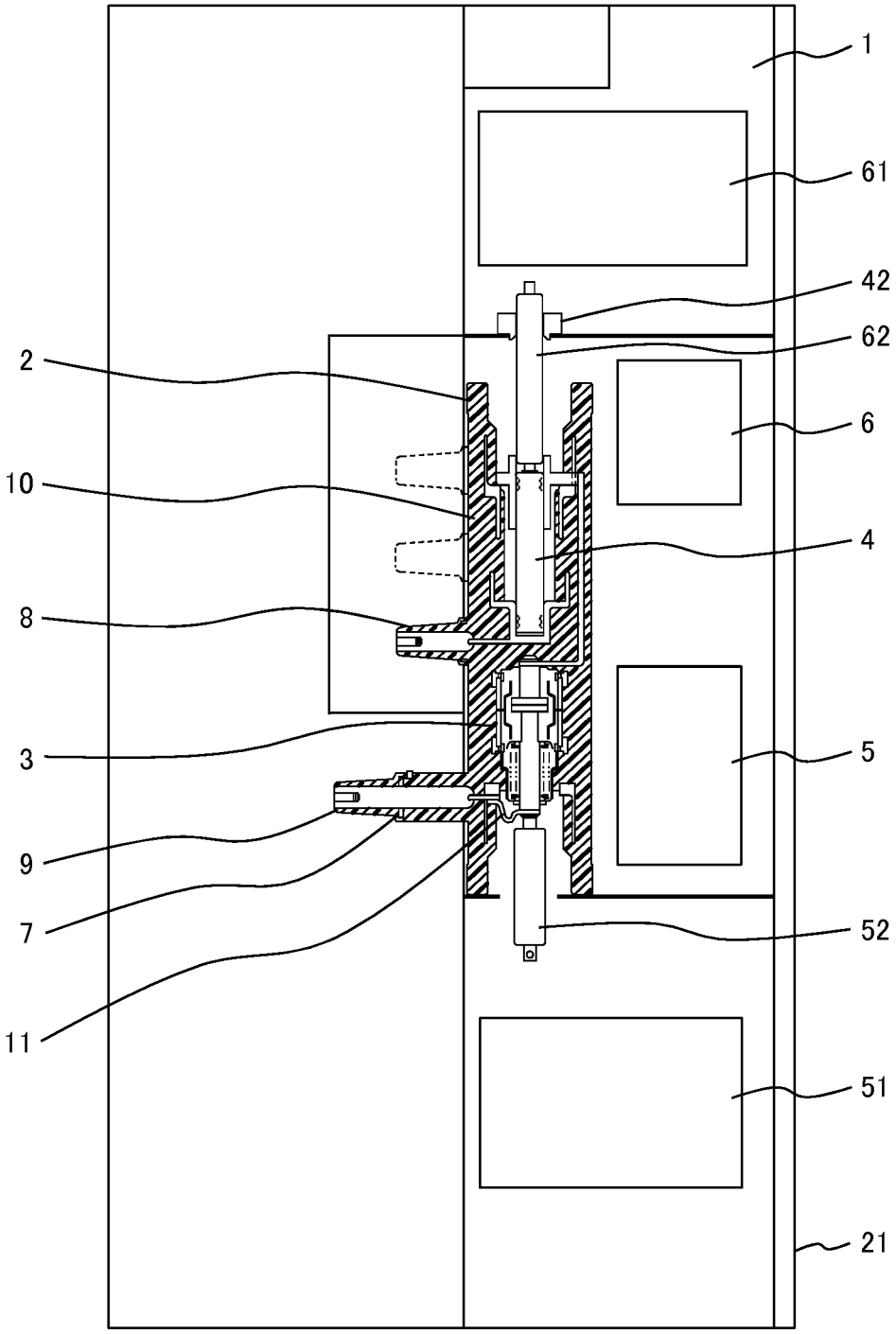
FIG. 1 is a side view that partially illustrates a cross section in an embodiment of the present invention.

As shown in FIG. 1, the switchgear 1 is substantially structured with a mold switch 2 equivalent to a switch unit, a bus 80 through which electric power is supplied from a power system to the mold switch 2, a cable 90 through which electric power is supplied from the mold switch 2 to a load, manipulation units 5 and 6 that operate switches in the mold switch 2, linkage units 51 and 61 that link the switches in mold switch 2 to the manipulation units 5 and 6, and a cabinet 21 that encloses these components. Note that FIG. 1 shows the components only for 1 phase, however, as shown in FIG. 2, the components having the same structure are arrayed for 3 phases while changing the height of the buses in the switchgear 1.

Figure 3:
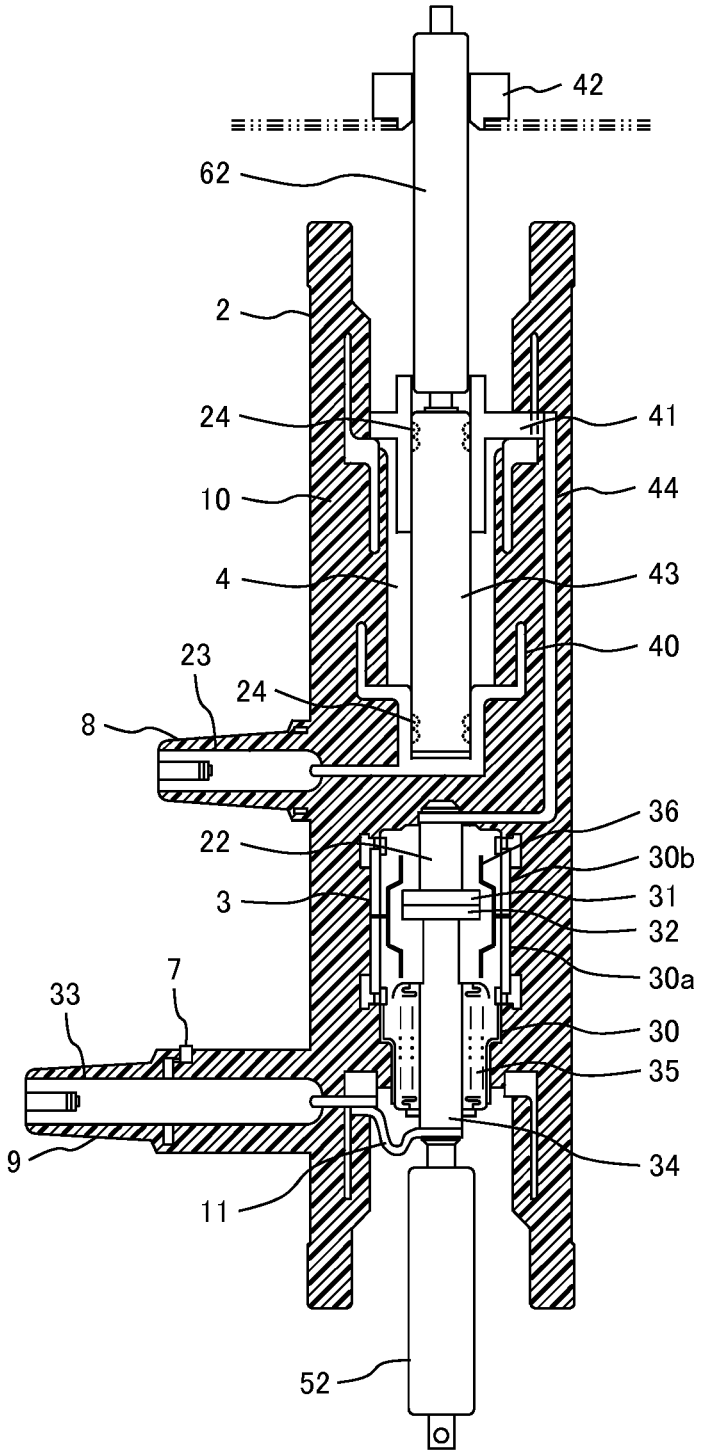
FIG. 3 is a cross sectional view of a mold switch in the embodiment of the present invention in FIG. 1.

As shown in FIG. 3, the mold switch 2 is formed by integrally molding, with an epoxy resin 10, a vacuum insulated switch 3 having a function of closing and interrupting a current, an air insulated switch 4 that is switchable among three positions, which are a closed position, a disconnected position, and a grounded position, a voltage detector 7 for measuring a voltage to be applied to a load side, a bus connecting bushing 8 connected to the bus 80, and a cable connecting bushing 9 connected to the cable 90, through which a current is supplied to the load. The vacuum insulated switch 3 and air insulated switch 4 are linearly disposed.

Each component will be described in detail. The vacuum insulated switch 3 has a vacuum case 30 formed by mutually connecting a fixed-side ceramics insulative tube 30*b*, a movable-side ceramics insulative tube 30*a*, a fixed-side end plate, and a movable-side end plate; the vacuum case 30 includes a fixed-side electrode 31, a movable-side electrode 32, a fixed-side conductor 22 connected to the fixed-side electrode 31, a movable-side conductor 34 connected to the movable-side electrode 32, and an arc shield 36 that protects the ceramics insulative tubes 30*a* and 30*b* from arcs generated when the electrodes are opened and closed. The movable-side conductor 34 extends outwardly of the vacuum case 30 through a metal bellows 35 and is connected to a central bushing conductor 33 for cable connection through a flexible conductor 11 to supply electric power from a bus side to the load side.

The movable-side electrode 32 is also connected to an insulative manipulation rod 52, so a manipulation force generated at the manipulation unit 5 is transmitted through the linkage unit 51 to the insulative manipulation rod 52.

The air insulated switch 4, which is connected to a central bushing conductor 23 for bus connection, includes a fixed electrode 40 connected to the bus side through the central bushing conductor 23, a ground-side fixed electrode 42 connected to ground, and an intermediate fixed electrode 41 disposed at an intermediate position between the fixed electrode 40 and the ground-side fixed electrode 42 in their axial direction, which functions as a guide for a movable electrode 43 and is electrically connected to the fixed-side conductor 22 in the vacuum insulated switch 3 through a connection conductor 44. The interior of the air insulated switch 4 is air-insulated. All these fixed electrodes have the same inner diameter and are linearly disposed. When the movable electrode 43 linearly moves among these fixed electrodes in the air insulated switch 4, a switchover among the three positions, which are the closed position, disconnected position, and grounded position, becomes possible. The movable electrode 43 is linked to an air-insulated manipulating rod 62. The air-insulated manipulating rod 62 is connected to the manipulation unit 6 through a linking device 61. Accordingly, the air-insulated manipulating rod 62 can be operated by the manipulation unit 6. Since spring contacts 24 are provided at portions with which the fixed electrodes come into contact, contacts are reliably formed due to elastic forces without impeding the movement of the movable electrode 43.

As described above, the vacuum insulated switch 3 is a switch disposed on the load side, and the air insulated switch 4 is a switch disposed on the bus side.

Electric connection between the vacuum insulated switch 3 and the air insulated switch 4 will be described. The intermediate fixed electrode 41 is always in contact with the movable electrode 43, regardless of the position of the movable electrode 43, so the intermediate fixed electrode 41 and movable electrode 43 always have the same potential. Since the intermediate fixed electrode 41 is electrically connected to the fixed-side conductor 22 in the vacuum insulated switch 3, the movable electrode 43, which is always at the same potential as the intermediate fixed electrode 41, is also electrically connected to the fixed-side conductor 22 in the vacuum insulated switch 3. However, the fixed-side conductor 22 and fixed electrode 40, which are placed close to each other, are insulated from each other due to solid insulation provided by the epoxy resin 10.

The bus connecting bushing 8 is formed by covering the circumference of the central bushing conductor 23 for bus connection with the epoxy resin 10, and the cable connecting bushing 9 is formed by covering the circumference of the central bushing conductor 33 for cable connection with the epoxy resin 10. The voltage detector 7 for measuring the potential of the load side is provided in the cable connecting bushing 9 in such a way that the voltage detector 7 is electrically connected to the central bushing conductor 33 for cable connection that passes through the interior of the cable connecting bushing 9. These two types of bushings are disposed on the same plane at the same side. The cable connecting bushing 9 is longer than the bus connecting bushing 8.

Figure 2:
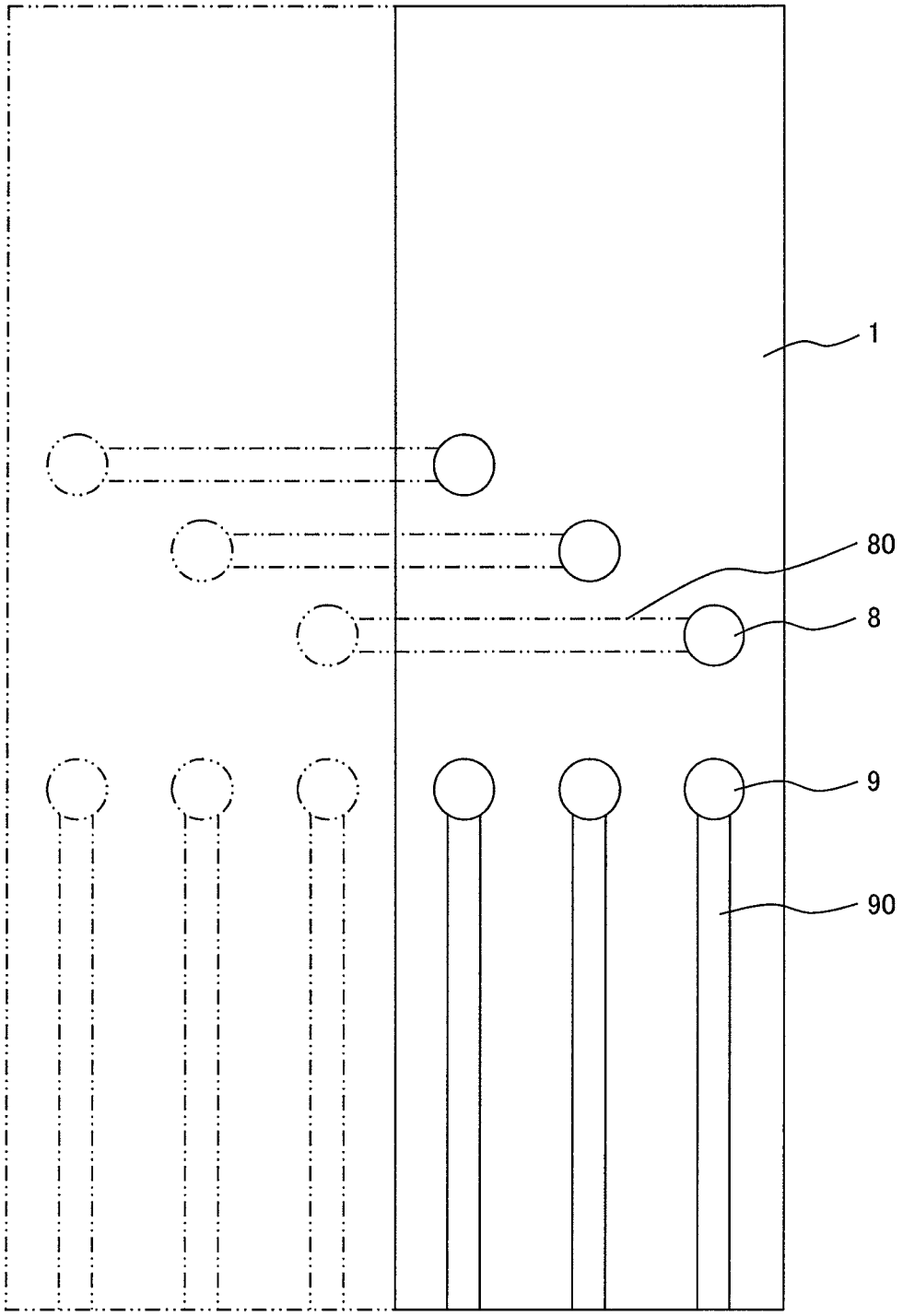
FIG. 2 is a rear view in the embodiment of the present invention.

FIG. 2 is a rear view of the two-panel switchgear 1 structured by placing two panels side by side; the bus connecting bushings 8 disposed on each panel are mutually connected with the bus 80. Although, in this embodiment, each cable 90 is drawn through the relevant cable connecting bushing 9 downwardly on the drawing sheet to supply electric power to the unit used as the load, the cable 90 can also be drawn upwardly on the drawing sheet by making the cable connecting bushing 9 longer than the bus connecting bushing 8.

The vacuum insulated switch 3 is operated by the electromagnetically operated manipulation unit 5, which is a first manipulation unit, through the linkage unit 51. A switchover among the three positions in the three-position air insulated switch 4 is carried out by the motor-driven manipulation unit, which is a second manipulation unit 6, through the linkage unit 61, the three positions being a closed position for supplying electric power, a disconnected position for protecting a maintenance worker from a surge voltage due to, for example, lightning and assuring safety for the worker, and a ground preparation position for grounding.

Although the first manipulation unit 5 is electromagnetically operated and the second manipulation unit 6 is driven by a motor, it is also possible to operate these manipulation units by other operating systems, for example, the motor charged spring stored energy system.

The closing, interrupting, disconnecting, and grounding operations of the mold switch 2 will be described.

The state in FIG. 1 is a closing state.

To shift from the closing state to an interrupting state, the manipulation unit 5 is manipulated so that the insulative manipulation rod 52 is moved away from the fixed-side electrode 31 through the linkage unit 51. The movable-side electrode 32 disposed at the end of the insulative manipulation rod 52 so as to face the fixed-side electrode 31 is then separated from the fixed-side electrode 31, causing the interrupting operation in the vacuum insulated switch 3.

A disconnecting operation is carried out next. A shift from the closing state to the disconnecting state is carried out after the interrupting operation has been completed. In this case, the manipulation unit 6 is manipulated so that the air-insulated manipulating rod 62 in the air insulated switch 4 is moved away from the fixed electrode 40 through the linkage unit 61. An inter-electrode distance between the movable electrode 43 and the fixed electrode 40 and another inter-electrode distance between the spring contact 24 attached to the movable electrode 43 and the fixed electrode 40 are then prolonged, shifting to the disconnecting state, in which the spring contact 24 is moved to a position at which the spring contact 24 is not placed in contact with the ground-side fixed electrode 42 or the fixed electrode 40. The switch unit in this embodiment has a double disconnection structure in which the state between the electrodes in the vacuum insulated switch 3 is the interrupting state and the air-insulated manipulating rod 62 is placed in the disconnecting state. The inter-electrode distances between the movable electrode 43 and the fixed electrode 40 and between the spring contact 24 attached to the movable electrode 43 and the fixed electrode 40 are preferably longer than the inter-electrode distance in the vacuum insulated switch 3 at the interrupting position so that even if, for example, the vacuum insulated switch 3 causes a vacuum leak, the reliability of the disconnecting state is not lowered.

The disconnecting state is then shifted to a grounding state. In the shift to the grounding state, the manipulation unit 6 is first manipulated after the above disconnecting operation has been completed so that the air-insulated manipulating rod 62 in the air insulated switch 4 is further moved away from the fixed electrode 40 through the linkage unit 61 until the spring contact 24 on the same side as the air-insulated manipulating rod 62 comes into contact with the ground-side fixed electrode 42. Accordingly, the ground-side fixed electrode 42 is electrically connected to the spring contact 24, movable electrode 43, intermediate fixed electrode 41, connection conductor 44, fixed-side conductor 22, and fixed-side electrode 31 in that order, causing these components to have the ground potential. That is, the inter-electrode potential in the vacuum insulated switch 3 is a difference between the ground potential applied to the fixed-side electrode 31 and the load-side potential applied to the movable-side electrode 32, so the load side is not grounded at that time.

The manipulation unit 5 is manipulated in this state so that the insulative manipulation rod 52 is moved toward the fixed-side electrode 31 through the linkage unit 51 until the movable-side electrode 32 disposed at the end of the insulative manipulation rod 52 facing the fixed-side electrode 31 comes into contact with the fixed-side electrode 31. Accordingly, the fixed-side electrode 31 and movable-side electrode 32 are electrically connected to each other and thereby the load side is grounded, completing the grounding operation.

The operations from the closing state to the grounding state do not always need to be performed. To shift from the closing state to the interrupting state or to the disconnecting state, for example, it suffices to stop at the time when the interrupting state or disconnecting state is entered. In addition, to shift from the grounding state to the closing state through the disconnecting state and interrupting state (including partial shifts such as a shift from the disconnecting state to the closing state, besides the complete shift from the grounding state to the closing state), the above procedure may be reversed.

In this embodiment, since the vacuum insulated switch 3 and air insulated switch 4 are structured so that a movable electrode in one switch and a fixed electrode in the other switch are electrically connected to each other, the bus and cable, which have a high voltage, are centralized rather than being distributed to the ends of the mold switch 2, enabling the mold switch 2 to be made to be compact. Since the switches are centralized in the axial direction, it is of course possible to make the mold switch 2 substantially compact in directions other than the axial direction. Furthermore, since the mold switch 2 occupies a large volume in the entire switchgear, the entire switchgear can also be made to be compact.

In addition to the electrical connection between a movable electrode in one switch and a fixed electrode in the other switch, a fixed electrode in the one switch and the fixed electrode in the other switch are isolated from each other. Therefore, even in a case in which the movable electrode in the one switch and the fixed electrode in the other switch are electrically connected to each other, a dielectric breakdown can be prevented. In a specific aspect of insulation in this embodiment, the epoxy resin 10 is used for solid insulation. Since resin molds such as the epoxy resin 10 are highly insulative and the insulation distance can thereby be shortened, the two switches can be brought close to each other in the axial direction. In an aspect in which a plurality of switches that tend to become large in the axial direction are placed in the axial direction, therefore, this embodiment can prevent the entire switchgear from becoming large and is thus advantageous.

In this embodiment, four circuit conditions for closing (current supply), interrupting (shutdown), disconnecting, and grounding are created according to the combination of the vacuum insulated switch 3 and three-position air insulated switch 4. Performance for closing, interrupting, and grounding is centrally achieved by the vacuum insulated switch 3, and performance for energization and isolation is achieved by the two switches, vacuum insulated switch 3 and three-position air insulated switch 4, simplifying the structure, providing insulation at a plurality of stages, and assuring safety and reliability. Even if a two-position air insulated switch is used instead of the three-position air insulated switch 4, insulation to ground at the disconnected position is provided at only one stage but the same advantage as with the three-position air insulated switch 4 can be obtained.

Since, in this embodiment, a plurality of switches is axially placed, the mold switch 2 can be formed in a substantially cylindrical shape (the bushings connected to the bus 80 and cable 90 are excluded). When the plurality of switches are placed in the switchgear 1, therefore, the size of the switchgear 1 can be reduced in directions other than the axial direction of the mold switch 2, making the switchgear 1 compact and lightweight. In addition, the structure of the mold switch 2 itself is rotationally symmetrical, enabling productivity to be improved.

Conductors are placed parallel to, for example, the vacuum insulated switch 3. When a current is passed in the conductors in the same direction as in the vacuum insulated switch 3 or in the reverse direction, an electromagnetic force is generated between the vacuum insulated switch 3 and the conductors in the suction direction or repulsion direction. To interrupt the current passing through the vacuum insulated switch 3, a method is used by which arcs generated between the electrodes at the time of interrupting the current are extinguished by generating a vertical magnetic field between the electrodes. Another interrupting method is to move the arcs on the circumferences of the electrodes so that the arcs are distributed and extinguished. Since the electromagnetic force generated between the vacuum insulated switch 3 and the conductors is horizontally exerted on the arcs, however, the magnetic field between the electrodes may be changed and the interrupting performance may be lowered. When conductors are placed parallel to a vacuum insulated switch, the conventional practice is to leave a distance therebetween so that the magnetic field between the electrodes is not affected when the current is interrupted. In this embodiment, however, insulation of the vacuum insulated switch 3 and insulation of the air insulated switch 4 are independent, and a horizontal electromagnetic force is not exerted on arcs generated when a current is interrupted by the vacuum insulated switch 3, thereby improving reliability.

Since a plurality of switches to be integrally molded are coaxially placed, the insulation structure of the plurality of switches becomes simple, so the spacing between the plurality of switches is not increased unnecessarily, enabling the thickness of the epoxy resin to be reduced. As a result, heat can be efficiently dissipated and the amount of resin to be used can be reduced.

Since the cable connecting bushing 9 and the bus connecting bushing 8 are placed on the same plane and on the same side, work operations can be performed for the switchgear 1 in one direction, improving workability during installation and maintenance.

Since the cable connecting bushing 9 is longer than the bus connecting bushing 8, it is possible to flexibly meet various specifications according to the installation environment of the user, such as a direction in which the cable 90 connected to the load are drawn and a two-stage structure of the buses 80.

As described above, FIG. 2 illustrates a rear view of the switchgear structured by placing two panels side by side; the bus connecting bushings 8 disposed on each panel of the two-panel switchgear are mutually connected with the bus 80, as an example; each cable 90 is drawn through the relevant cable connecting bushing 9 downwardly on the drawing sheet to supply electric power to the unit used as the load. However, the cable 90 can also be drawn upwardly on the drawing sheet by making the cable connecting bushing 9 longer than the bus connecting bushing 8.

Although the bus connecting bushing 8 may of course be longer than the cable connecting bushing 9, it is advantageous to freely wire the cables to be connected to the load to meet user requirements according to the installation environment of the user, so the cable connecting bushing 9 is made to be longer than the bus connecting bushing 8 to prevent the bus from interfering with the cable. If the cable connecting bushing 9 and the bus connecting bushing 8 are rotatably connected by, for example, using a T-shaped cable head, a direction in which the cables are drawn can be more advantageously adjusted at a site at which the switchgear is installed.

Second Embodiment

Figure 4:
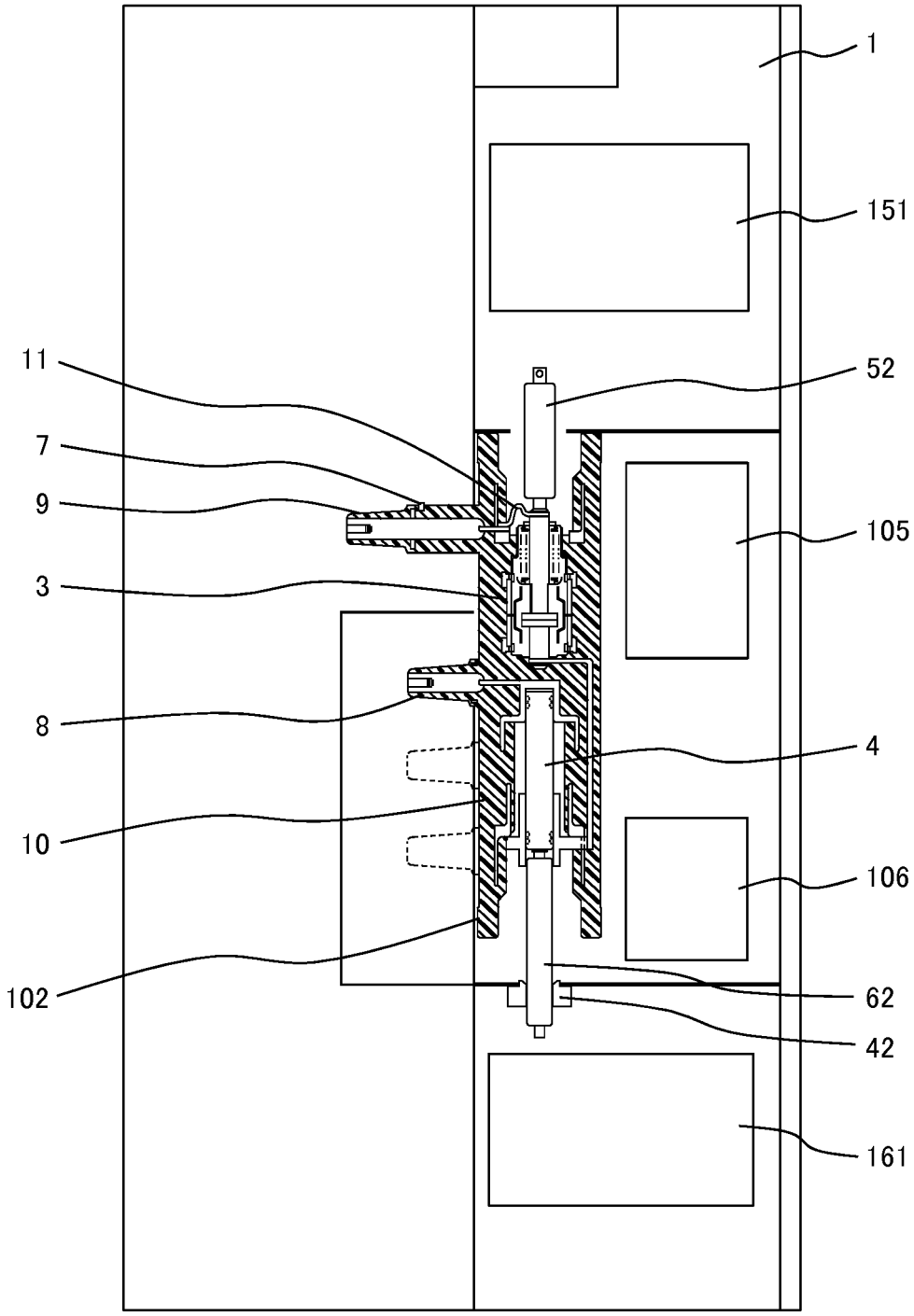
FIG. 4 is a side view that partially illustrates a cross section in another embodiment of the present invention.

A second embodiment will be described with reference to FIG. 4. In this embodiment, a mold switch 102 is used, which is identical to the mold switch 2 used in the first embodiment, but is vertically reversed. To conform to this arrangement, the positions of manipulation units 105 and 106, corresponding to the manipulation units 5 and 6, are also vertically reversed as compared with the first embodiment, and the positions of linkage units 151 and 161, corresponding to linkage units 51 and 61, are also vertically reversed as compared with the first embodiment. The other components are the same as in the first embodiment, so duplicate descriptions will be omitted.

Even if the mold switch 102, which is vertically reversed, is used as in this embodiment, the same effect as in the first embodiment described above can be obtained.

In the above embodiments, the fixed-side electrode in the vacuum insulated switch 3 and the movable electrode in the air insulated switch 4 connected to the bus side are electrically connected to each other, the vacuum insulated switch 3 and air insulated switch 4 being linearly disposed, and the bus 80 are placed near the center of the panel. Even if a need to vertically reverse the mold switch arises to meet user requirements or for some other reason, since the bus 80 remain near the center of the panel, workability is not largely changed. If the cable can be drawn upwardly and downwardly, the wiring of the cable is not impeded regardless of the positions of the cable connecting bushing 9.

Since, in the above embodiments, the movable electrode in the air insulated switch 4, which is connected to the bus side and has closing and grounding functions, and the fixed-side electrode in the vacuum insulated switch 3 are electrically connected to each other, even if a plurality of switches are coaxially and linearly disposed, a circuit can be formed in which a switch on the bus side has a grounding function and only a switch on the load side has an interrupting function. When a plurality of switches are linearly arranged, they are usually placed, due to a limitation on space, so that movable electrodes in the plurality of switches move away from each other. In this case as well, to have the switch on the bus side have a grounding function, it is necessary to connect the movable electrode in the switch on the bus side, rather than the fixed-side electrode, to the switch on the load side. This structure not only provides the above effect obtained from the linear arrangement but also eliminates the need for the switch on the bus side to have interrupting characteristics, simplifying the structure.

Furthermore, since the air insulated switch 4 has a disconnecting function as well, there is no need to provide a disconnector separately, further simplifying the structure and contributing to compactness.

When the present invention is implemented, each switch is not limited to a particular insulation method such as air insulation, vacuum insulation, or gas insulation. If an insulation method providing good insulation performance, such as vacuum insulation, is used, a further effect of contributing to compactness can be obtained.

The invention claimed is:

1. A switch unit, comprising:

a first switch, and a second switch being linearly disposed with the first switch, wherein the first switch has a fixed electrode and a movable electrode that is selectively moved toward and away from the fixed electrode thereof, the second switch has a fixed electrode and a movable electrode that is selectively moved toward and away from the fixed electrode thereof, the first switch and the second switch are placed so that the moveable electrode in the first switch and the movable electrode in the second switch move away from each other when the first switch and the second switch open, and the movable electrode in the first switch and the fixed electrode in the second switch are permanently electrically connected to each other.

2. The switch unit according to claim 1, wherein:

the first switch is an earthing switch, the second switch is an interrupter switch, the fixed electrode in the earthing switch is electrically connected to a bus, and the movable electrode in the interrupter switch is electrically connected to a cable.

3. A switch unit, comprising:

a plurality of switches being linearly disposed, wherein each of the plurality of switches has a fixed electrode and a movable electrode that is selectively moved toward and away from the fixed electrode, the fixed electrode in a first switch of the plurality of switches is electrically connected to a bus, the movable electrode in a second switch of the plurality of switches is electrically connected to a cable, the movable electrode in the first switch and the fixed electrode in the second switch are electrically connected to each other without providing a switch between them, solid insulation is provided between the fixed electrode in the first switch and the fixed electrode in the second switch, and the solid insulation is located on an axis of movement of the movable electrodes in the first switch and the second switch.

4. A switch unit, comprising:

a plurality of switches being linearly disposed, wherein each of the plurality of switches has a fixed electrode and a movable electrode that is selectively moved toward and away from the fixed electrode, the fixed electrode in a first switch of the plurality of switches is electrically connected to a bus, the movable electrode in a second switch of the plurality of switches is electrically connected to a cable, the movable electrode in the first switch and the fixed electrode in the second switch are electrically connected to each other, solid insulation is provided between the fixed electrode in the first switch and the fixed electrode in the second switch, and the solid insulation is located on an axis of movement of the movable electrodes in the first switch and the second switch.

5. The switch unit according to claim 4, wherein the solid insulation is provided by resin mold.

6. The switch unit according to claim 4, wherein the switch unit is molded with a resin in a substantially cylindrical shape.

7. The switch unit according to claim 4, wherein:

the first switch is disposed on a bus side; and the second switch is disposed on a load side.

8. The switch unit according to claim 7, wherein the bus-side first switch has a closing function and a grounding function; and the load-side second switch has a closing function and an interrupting function.

9. The switch unit according to claim 8, wherein the bus-side first switch has the closing function, a disconnecting function, and the grounding function.

10. The switch unit according to claim 7, wherein:

the bus-side first switch has a bus-side bushing connected to the bus;

the load-side second switch has a load-side bushing connected to a load-side cable; and the bus-side first switch and the load-side second switch are disposed on a same plane, and the bus-side bushing and the load-side bushing are disposed on a same side.

11. The switch unit according to claim 10, wherein the load-side bushing is longer than the bus-side bushing.

12. A switchgear comprising:

the switch unit according to claim 4;

a bus connected to the switch unit;

a cable connected to the switch unit; and a cabinet in which at least part of the switch unit, the bus, and the cable are accommodated.

13. The switch unit according to claim 4, wherein the movable electrode in the first switch is electrically connected with the fixed electrode in the second switch through an intermediate fixed electrode in the first switch, and the intermediate fixed electrode is located at a position away from the fixed electrode in the second switch than the fixed electrode in the first switch.

* * * * *